United States Patent [19]

Nelson

[11] Patent Number: 5,009,021

[45] Date of Patent: Apr. 23, 1991

[54] ADJUSTABLE GUN BUTT

[76] Inventor: Jerry T. Nelson, Rte. 2, Box 116, Cherokee, Ala. 35616

[21] Appl. No.: 496,713

[22] Filed: Mar. 21, 1990

[51] Int. Cl.[5] ..... F41A 23/20

[52] U.S. Cl. ..... 42/73

[58] Field of Search ..... 42/73, 71.01, 72, 74

[56] References Cited

U.S. PATENT DOCUMENTS

| | | | |
|---|---|---|---|
| 1,088,862 | 2/1914 | Perkins | 42/73 |
| 1,847,777 | 3/1932 | Morgan | 42/73 |
| 2,066,218 | 12/1936 | Morgan | 42/73 |
| 3,665,632 | 5/1972 | Ford | 42/73 |
| 4,422,256 | 12/1983 | Maucher et al. | 42/73 |
| 4,589,219 | 5/1986 | Milliman | 42/73 |

*Primary Examiner*—Michael Carone

*Attorney, Agent, or Firm*—Sughrue, Mion, Zinn Macpeak & Seas

[57] ABSTRACT

An adjustable gun butt assembly includes two plates, one of which is attached to the gun butt and the other which is attached to a resilient shoulder pad. The two plates move relative to one another by way of an eccentric cam disposed in one of the plates. The plates are held in frictional contact to one another by a single set screw accessible through an aperture in the resilient shoulder pad. The shoulder pad may be adjusted orthogonally by way of the cam and additional vertical movement is allowed by way of an extended slot. Sand paper may be fixed to one of the plates to provide a frictional grip between the two plates when the set screw is tightened.

4 Claims, 1 Drawing Sheet

FIG. 1
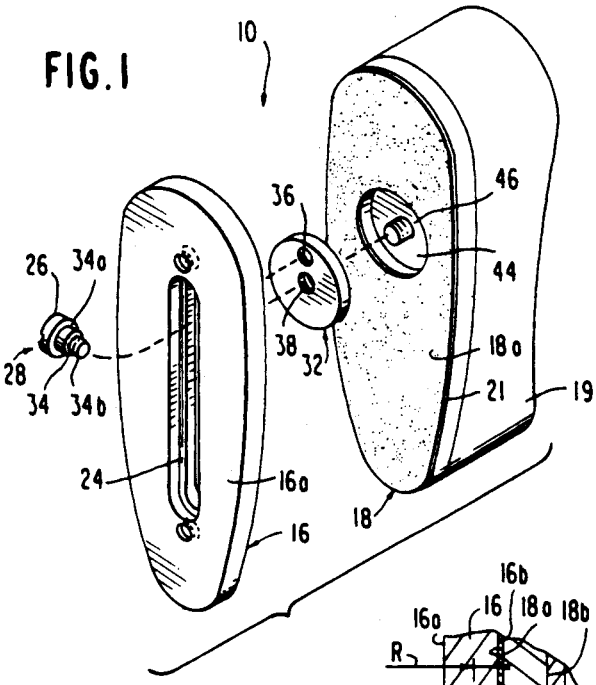
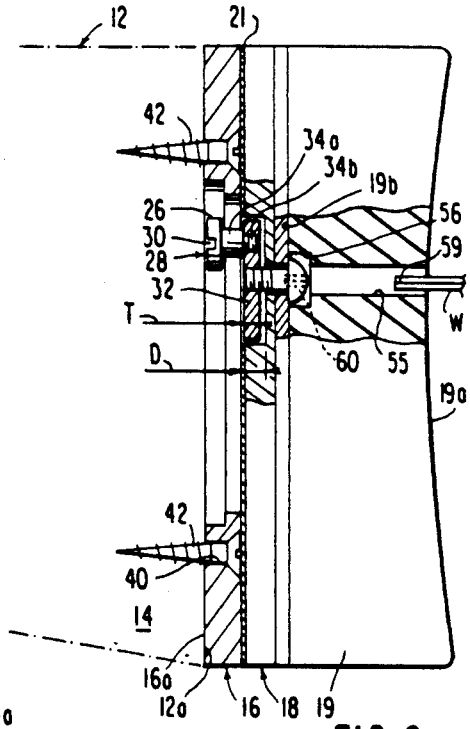
FIG. 2
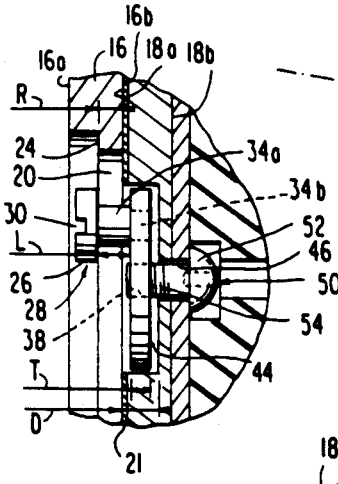
FIG. 3
FIG. 4
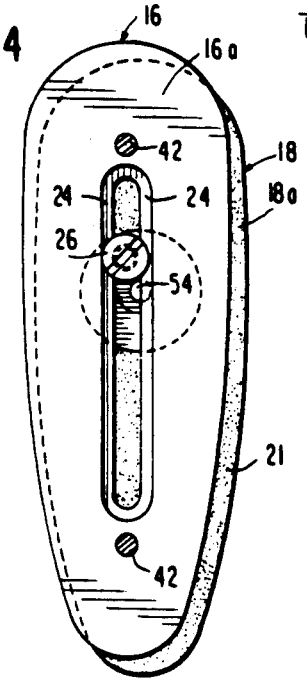
FIG. 5
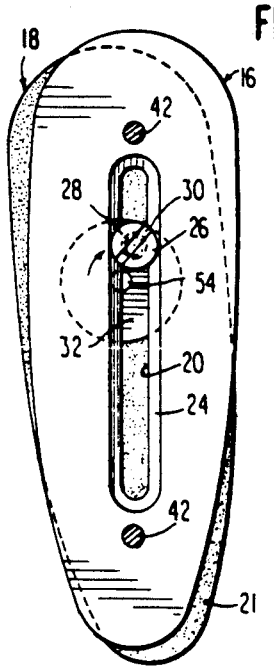

ADJUSTABLE GUN BUTT

The invention relates to adjustable gun butts, in which the gun butt may be adjusted both horizontally and vertically, that is orthogonally to a gun stock, and more particularly to a simplified adjustment assembly requiring tightening and loosening a single adjustment screw, preferably through a hole within the gun butt shoulder pad.

Adjustable butt plates and gun pads have developed over the years and are exemplified by U.S. Pat. No. 1,088,362 to Perkins, issued Feb. 24, 1914; U.S. Pat. No. 1,582,395 to Haemmerli, issued Apr. 27, 1926; U.S. Pat. No. 1,651,299 issued to R. V. Stansel on Nov. 29, 1927; and U.S. Pat. No. 1,847,777 to W. J. Morgan, issued Mar. 1, 1932.

The present invention is an improvement and a development from yet another U.S. Pat. No. 2,066,218 to W. J. Morgan, issuing Dec. 29, 1936. The adjustable gun butt of U.S. Pat. No. 2,066,218 permits adjustment simultaneously both horizontally in relation to the gun stock and vertically. A first plate provided with a central slot is secured to the gun stock by means of screws. An adjustable bolt projects through a slot having a head slidably maintained in the recess within the first plate. The face of the first plate remote from the gun stock engages a facing surface of a similarly shaped second plate to permit vertical adjustment of the second plate and the gun butt path in relation to the gun stock. The second plate is provided with a recessed area on the surface opposite that abutting the first plate. A centrally located opening is provided in the recessed area of the second plate of circular form which holds a circular rotatable cam of slightly smaller diameter. The cam is held on the bolt by means of a nut and the rotatable cam provides a horizontal adjustment in the position of the second plate relative to the first plate. The rotatable cam includes a large diameter section mounted within a recess whose diameter is in excess of the lateral width of the second plate bearing that recess. A smaller diameter concentric portion fits within the central opening within the second plate, extending through the second plate from the recess of the second plate. The cam, therefore, is rotated by means of protruding edges which project to opposite lateral sides through holes within the sides of the second plate opening to the recess within that plate. In order to manipulate the cam, the nut on the bolt is loosened. A tapped hole eccentric to the axis of the cam, receives the threaded end of the adjustable bolt with the head of that bolt slidable within the recess of the first plate. After loosening of the adjustable bolt, the second plate may be moved to the right or left of the first plate by rotation of the cam. When the desired adjustment is made, the nut holding the cam on the adjustable bolt is tightened.

While the adjustable gun butt of U.S. Pat. No. 2,066,218 provides both vertical and horizontal adjustment of the gun butt relative to the gun stock, the adjustment mechanism is complicated, requires the loosening of the nut on adjustable bolt, and the manual rotation of the protruding peripheral large diameter portions of the cam outside, to the sides of the second plate supporting the same.

It is, therefore, a primary object of the present invention to provide an improved adjustable gun butt of this type in which there is no need to remove the butt plate cushion from the assembly to effect adjustment, wherein a single set screw accessible through a single hole drilled through a soft cushion forming a shoulder pad permits ready adjustment of the gun butt orthogonally relative to the gun stock via an adjustment assembly of simplified form.

BRIEF DESCRIPTION OF THE DRAWINGS

FIG. 1 is an exploded perspective view of the adjustable gun butt assembly forming a preferred embodiment of the invention.

FIG. 2 is a side elevational view, partially broken away, of the adjustable gun butt assembly of FIG. 1 mounted to the rear of a gun stock, with first and second plates thereof loosely coupled and permitting adjustment both vertically and horizontally of the resilient shoulder pad.

FIG. 3 is an enlarged, sectional view of a portion of the adjusting mechanism illustrated in FIG. 2 after locking the resilient shoulder pad in desired position relative to the gun stock.

FIG. 4 is an end view of the adjustable gun butt assembly of FIG. 1, with a first plate to the left of a second plate of that assembly prior to a desired adjustment.

FIG. 5 is a similar end view after shifting of the first plate to the right relative to the second plate, using the adjusting system of the present invention.

DESCRIPTION OF THE PREFERRED EMBODIMENTS

Referring to the drawings, the adjustable gun butt assembly indicated generally at 10, FIG. 1, has particular application to skeet and field shooting where it is necessary to move a shotgun quickly into position for shooting. A shotgun 12 bearing assembly 10 in FIG. 2 has gun stock 12 illustrated in phantom lines, to which assembly 10 is mounted by way of a pair of screws 42 for fixedly mounting a first plate 16 of assembly 10 to the rear vertical face 12*a* of gun stock 12. The first plate 16 abuts a second plate 18 face-to-face, and plates 16, 18 are functionally the equivalent to the two plates of the adjustable gun butt of U.S. Pat. No. 2,066,218. Plate 16 is provided with a laterally central, longitudinally extending, central, vertical slot 20 which is enlarged by an oval recess to form laterally opposed recessed flat edges 24, upon which ride opposite flat surfaces of head 26 of shoulder bolt indicated generally at 28. The head 26 of that bolt is provided with a slot 30 for receiving the end of a screwdriver and permitting a shank 34 of the shoulder bolt 28 to be fixed to a rotatable cam disk indicated generally at 32. The shoulder bolt 28 seen in the various Figures has the shank as including a smooth surface, large diameter portion 34*a* extending directly from the head 26 and terminating in a reduced diameter threaded portion 34*b*.

The rotatable cam disk 32 has a diameter in excess of the diameter of shank portion 34*a* of the shoulder bolt 28. Further, cam 32 is provided with an eccentric tapped hole 36, sized to and threadably receiving threaded small diameter portion 34*b* of the shoulder bolt 28. Additionally, the circular rotatable cam disk 32 includes a tapped center hole 38 of somewhat larger diameter. Plate 16, whose oval exterior configuration matches that of gun stock 14, and that of second plate 18 and elastomeric shoulder pad 19, further comprise a pair of screw holes 40 through which projects the threaded shanks of screws 42. FIG. 2, fixedly mounting plate 16 with the front face 16*a* thereof in contact with vertical rear end face 12*a* of the gun stock 12.

The second plate 18 is provided with a rough, surface front face 18*a* (effected by adhesively mounting a sheet 21 of sandpaper on plate 18) facing the direction of the first plate 16 such that upon locking plates 16, 18 together, they are prevented from moving due to the high friction interference of the grit on face 18*a* of plate 18 contacting rear face 16*b* of the first plate 16.

As may be seen by reference to FIGS. 1, 2 and 3, a circular recess 44 is formed within the front face 18*a* of second plate 18 at the transverse center of that plate which is of a diameter slightly in excess of the diameter of the rotatable cam disk 32. Further, a small diameter smooth bore hole 46 is drilled through the second plate 18, coaxial with recess 44, of a diameter in excess of the tapped center hole 38 of the rotatable cam disk 32. The rotatable cam disk 32 is received within recess 44, FIGS. 2, 3. Further, the thickness T of the rotatable cam disk 32, FIG. 2, is less than the depth D of the recess 44 within the front face 18*a* of the second plate 18 receiving the disk. Allen head set screw 50 has a head 52 which is of a diameter in excess of the smooth bore hole 46 within plate 18, opening to recess 44, and has a threaded shank 54 which is threaded into tapped center hole 38 of the rotatable cam disk 32. Purposely, the resilient shoulder pad 19, which may be formed of molded rubber having the same exterior plan configuration of the first plate 16 and that of the second plate 18 (as well as the gun stock 14 at the rear end face of the gun 12) has a concave rear end face 19*a* remote from the second plate 18, to which a rubber pad 19 is affixed at its vertical front face 19*b*. Prior to adhesively fixing the shoulder pad 19 to plate 18, the pad is provided with a bore or hole at 55, counterbored at 56 at front face 96 of the pad 19. The counterbore 56 is of a diameter sufficient to receive head 52 of the Allen head set screw 50, while the bore 55 is sized so as to permit the end 59 of an Allen head wrench W to be inserted. FIG. 2, such that end 59 may project into an axial bore 60 matching the hexagonal cross-section of the Allen head wrench, within head 50 of the Allen head set screw, to permit the set screw 50 to be threaded into or backed from the tapped center hole 38 of the rotatable cam disk 32.

Furthermore, the length L of the smooth surface shank portion 34*a* of the shoulder bolt is in excess of the distance R from recess face 24 to the rear face 16*b* of the first plate 16. With the shoulder bolt 28 being fully threaded into the tapped eccentric hole 36 of the rotatable cam disk under conditions shown in FIG. 2, not only is the shoulder bolt 28 free to slide up and down within slot 20 via shank portion 34*a*, but the rotatable cam disk 32 is free to rotate about its axis under any attempt to shift the first plate 16 laterally relative to the second plate 18, with Allen head set screw backed out slightly from cam disk 32. FIG. 2.

As may be appreciated by the description above, and by further reference to FIGS. 4 and 5, adjustment of the position of the adjustable gun butt assembly 10, and importantly the rubber shoulder pad 19, relative to the gun stock 14 is accomplished by loosening of the Allen head set screw 50. This releases the friction grip between the bottom face of the shoulder bolt head 26*a* and the oval shoulder face 24 formed by the recess and slot 20 which, in turn, releases the frictional grip between the facing surfaces 16*b* and 18*a* respectively of the first and second plates 16, 18.

As indicated in FIG. 4 while the parts are assembled but loosely fitted, as indicated in the broken away portion of FIG. 2, physically the gun stock 14 and its plate 16 which is screwed thereto by screws 42, may be shifted from FIG. 4 to the right, FIG. 5, during which action the shoulder bolt rotates about the axis of adjustment screw shank 54 clockwise, as shown by the arrow, such that the lateral offset of the first plate 16 and the gun stock 14 to the left. FIG. 4, is eliminated and the offset to the right as clearly created. FIG. 5. In that action, the rotatable cam disk 32 rotates, as well as the shoulder bolt, approximately 60° . Independent of that rotation, the shoulder bolt 28 may ride up and down within slot 20 vertically to the extent permitted by the length of the elongated slot 20 within the first plate 16 to shift the plate 16 vertically relative to plate 18. Upon completion of the desired shift of the shoulder pad 19 relative to the gun stock 14, it is only necessary to screw down the adjustable Allen head set screw 50 using the Allen head wrench W of FIG. 2 to cause the rotatable cam disk 32 to be drawn inwardly within circular recess 44 within face 18*a* of the second plate 18 to the extent where shoulder bolt 28 head face 26*a* tightly, frictionally engages the oval shoulder face 24 within recess of the slot 20 of the first plate 16. This action simultaneously locks the rear face 16*b* of the first plate frictionally against the grit surface of the sandpaper sheet 21 affixed to the front face 18*a* of the second plate 18. With the plates 16, 18 locked face-to-face, the desired adjustment both horizontally and vertically of the shoulder pad 19 of the gun butt assembly 10 is maintained relative to the gun stock 14. The shoulder pad 19 may be molded of soft rubber in the manner of U.S. Pat. No. 2,066,218.

Having illustrated and described the principles of the invention with reference to a preferred embodiment, it should be apparent to those persons skilled in the art that such invention can be modified in arrangement and details without departing from such principals.

What is claimed is:

1. An adjustable gun butt assembly comprising:

first and second face abutting plates having respective front and rear faces, said first plate adaptable to be fixed via said front face to a rear face of a gun stock, a slot in said first face of said first plate adapted to receive and slidably retain the head of a shoulder bolt therein, a circular recess within said front face of said second plate, a rotatable cam disk of a diameter slightly smaller than said circular recess and positioned therein for rotation about coincident axes of the cam disk and circular recess, a first tapped hole within the center of said rotatable cam disk, a second tapped hole within said rotatable cam disk eccentric to said first tapped hole, a hole extending through said second plate coaxial with said circular recess, a resilient shoulder pad having a front face affixed to said rear face of said second plate, and having a hole passing from a rear face of said pad to said pad front face, therethrough parallel to and positionable in line with said hole extending through said second plate, and an adjusting set screw having a head and a threaded shank with said threaded shank sized to and threaded into said first tapped hole in said rotatable cam disk, said shoulder bolt having a threaded shank of predetermined length, and being threaded into said eccentric second tapped hole of said rotatable cam disk such that said shoulder bolt slides freely within said slot of said first plate when said set screw is loosened, and wherein the thickness of said rotatable cam disk is less than the depth of said circular recess receiving the same whereby, with said set screw threaded shank backed out of said first tapped hole, said second plate and said shoulder pad are free to move relative to said first plate and gun stock orthogonally by rotation of said shoulder bolt eccentrically about the axis of said rotatable cam disk as the disk rotates within said circular recess of said second plate and by movement said shoulder bolt independently over the length of said elongated slot, and wherein upon tightening down said set screw, said rotatable cam disk is pulled deeper into said circular recess, causing the shoulder bolt head to drive said first plate into frictional engagement with said second plate to lock said plates together.

2. The adjustable gun butt assembly as claimed in claim 1 wherein said second plate front face has adhesively mounted thereto a sheet of sandpaper having grit thereof facing the rear face of said first plate for frictional engagement therewith.

3. The adjustable gun butt assembly as claimed in claim 1, wherein said set screw includes a small diameter Allen head hole drilled axially into said head in the direction of said shank, sized and configured to an Allen head wrench, such that adjustment is effected by extending the end of an Allen head wrench through said hole within said resilient shoulder pad and penetrating said Allen head hole within the head of said set screw and by rotation of the Allen head wrench.

4. The adjustable gun butt assembly as claimed in claim 3, wherein said hole extending through said resilient gun pad from said rear face to said front has a diameter slightly in excess of the diameter of said Allen head wrench and terminates at said pad front face, in a radially enlarged portion having a diameter in excess of the diameter of the head of said set screw and receiving the head thereof.

* * * * *